United States Patent [19]

Spencer

[11] Patent Number: 4,949,462

[45] Date of Patent: Aug. 21, 1990

[54] DRYWALL CUTTING GUIDE

[76] Inventor: Michael P. Spencer, 415 W. Jefferson St., Marshfield, Wis. 54449

[21] Appl. No.: 265,931

[22] Filed: Nov. 2, 1988

[51] Int. Cl.[5] ..... B26B 29/00

[52] U.S. Cl. ..... 30/293; 30/294; 33/42

[58] Field of Search ..... 30/289, 290, 294, 376, 30/373, 293; 83/614, 745; 33/32.1, 32.2, 41.1, 41.5, 42

[56] References Cited

U.S. PATENT DOCUMENTS 2,090,183 8/1937 Capstick ..... 30/293

3,286,351 11/1966 McAlister ..... 33/42

*Primary Examiner*—Douglas D. Watts

*Attorney, Agent, or Firm*—Charles F. Meroni, Jr.

[57] ABSTRACT

A drywall cutting device that includes a channel-shaped sleeve for slidably mounted disposition on a stem of a T-square at predetermined selectable positions. A handle operated clamping device is mounted on and secured with the channel-shaped sleeve for retaining the sleeve in a predetermined selected fixed position on the stem of a T-square. The device includes a handle projecting above the sleeve for overlying a T-square. A knife holder is joined with the sleeve, and a knife is adjustably secured with the knife holder at right angles to the channel for cutting a line perpendicular to the stem of the T-square when the clamping device and the T-square are drawn together across a surface to be cut.

13 Claims, 3 Drawing Sheets

DRYWALL CUTTING GUIDE

BACKGROUND OF THE INVENTION

The present invention is concerned with a new and improved drywall cutting device for quickly cutting boards of various types such as a drywall board. The device that I have invented is particularly cooperable with a T-square and is adapted to be fixedly mounted on the stem of the T-square. The cutting device is positioned in such a way that its knife is located at right angles to the stem but parallel to the cross piece of the T-square. The drywall cutting device is further provided with a handle so that the user can grasp the handle with one hand and the cross piece of the T-square with the other hand and then draw or move the T-square and the drywall cutting device across the drywall board with the cross piece of the T-square engaged against an edge of the drywall board to act as a guide so that the cutting device and particularly the knife can be drawn across the drywall board in a straight line parallel with the edge of the drywall where the cross piece of the T-square is engaged. My drywall cutting device is believed to be of a rather uncomplicated construction and can be readily made at a relatively low cost for large scale production and sale.

My new and improved drywall cutting guide enables the user to produce a clean, straight, horizontal cut across a drywall board in a single operation. It is further my belief that my drywall cutting guide is faster, cleaner, straighter cutting and more accurate than any other tool that is known to me for the purposes of cutting boards such as drywall and the like.

DESCRIPTION OF THE PRIOR ART

Heretofore, various tools have been used for cutting drywall boards and the like, and in this connection these tools have involved methods of different types, as follows:

1. Either snapping a chalkline or placing a straight edge across the drywall.
2. Cutting the drywall.
3. Using a rasp or coarse sandpaper to even the rough edge.

Other devices have also come to my attention as a result of my review of the state of the art. Examples of prior techniques now known to me are illustrated in the following U.S. Pat. Nos.:

| Pat. No. | Patentee |
|---|---|
| 871,731 | E. N. McKelvey & I. E. Eells |
| 1,043,902 | R. S. N. Burdick |
| 1,555,653 | M. Frank |
| 2,144,697 | S. J. Zangrando |
| 2,466,357 | W. K. Beith |
| 2,818,644 | C. T. Crawford |
| 3,286,351 | R. McAlister |
| 3,439,426 | R. D. Wilson |
| 3,762,046 | Paul Kolomick |
| 4,255,856 | Malcolm Mackie |

The only patents that appear in any way relevant to the subject matter of my invention are U.S. Pat. Nos. 2,466,357 and 3,286,351. These patents appear to show devices that appear to assist in drawing lines or cutting along a line parallel to the crossbar of the "T". The Beith U.S. Pat. No. 357' shows a Try square, but it is believed that my device is simpler and of a superior construction. The Burdick U.S. Pat. No. 1.043,902 shows a woodworking tool that includes a Try Square 1 having the inventor's so-called "Improved Device" comprising a blade 5 as noted in line 46–55 of column 1 of the patent. Here the patentee has a blade holder of sorts in the form of a pencil (FIG. 5) where the pencil holder is movable longitudinally along the length of the blade 2 of the Try square for the purpose of drawing a line or cutting the surface along a line as shown and described. The pencil works in parallelism with the blade rather than in parallelism with the handle 1 of the square, in contrast to my drywall cutting guide.

SUMMARY OF THE INVENTION

My invention concerns a drywall cutting device that includes a channel-shaped sleeve for slidably mounted disposition on a stem of a T-square at predetermined selectable positions, a clamping device mounted on the channel-shaped sleeve for retaining the sleeve in a predetermined selected fixed position on the stem of a T-square, a knife holder being joined with the sleeve, and a knife adjustably secured with the knife holder at right angles to the stem for cutting a line perpendicular to the stem of the T-square when the clamping device and the T-square are drawn together across a surface to be cut.

According to other features of my invention, the clamping device includes a handle that extends above the channel shaped sleeve for assisting in drawing the device across a surface to be cut.

According to yet other features of my invention, the clamping device includes a threaded screw extended through the channel shaped sleeve in threaded assembly therewith and on end extended into a channel shaped area defined by the channel shaped sleeve, the end being adapted for retaining engagement with a T-square.

Still further features of my invention concern my drywall cutting guide and its knife holder which is fixedly attached to the sleeve at one end thereof, the knife being engaged thereagainst, and means securing the knife to the knife holder.

My invention concerns a drywall cutting device that includes a channel-shaped sleeve for slidably mounted disposition on a stem of a T-square at predetermined selectable positions, a handle operated clamping device mounted on and secured with the channel-shaped sleeve for retaining the sleeve in a predetermined selected fixed position on the stem of a T-square, the device including a handle projecting above sleeve for overlying a T-square, a knife holer being joined with the sleeve, and a knife adjustably secured with the knife holder at right angles to said channel for cutting a line perpendicular to the stem of the T-square when the clamping device and the T-square are drawn together across a surface to be cut.

Other features of my invention concern a new and improved combination which includes a drywall cutting device and a T-square, the drywall cutting device including a channel-shaped sleeve for slidably mounted disposition on a stem on the T-square at predetermined selectable positions, a handle operated clamping device mounted on and secured with the channel-shaped sleeve for retaining the sleeve in a predetermined selected fixed position on the stem of the T-square, the device including a handle projecting above the sleeve for overlying a T-square, a knife holder being joined with the sleeve, and a knife adjustable secured with the knife holder at right angles to said channel for cutting a line perpendicular to the stem of the T-square when the clamping device and the T-square are drawn together across a surface to be cut.

BRIEF DESCRIPTION OF THE DRAWINGS

Further features, objects and advantages of the invention will be found throughout the following more detailed description which refers to the accompanying drawings, disclosing several embodiments, wherein.

DESCRIPTION OF THE PREFERRED EMBODIMENT

Figure 1:
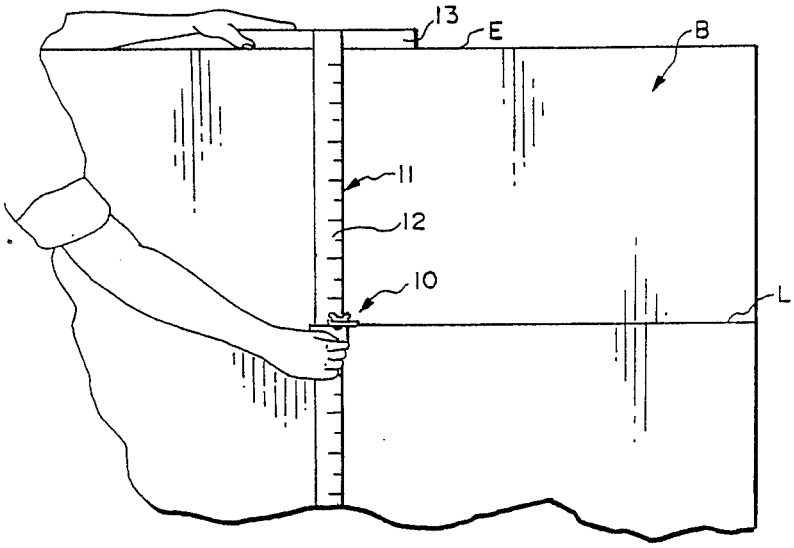
FIG. 1 is a fragmentary top plan view of my drywall cutting device showing the way in which it can be used for cutting a drywall board.
Figure 2:
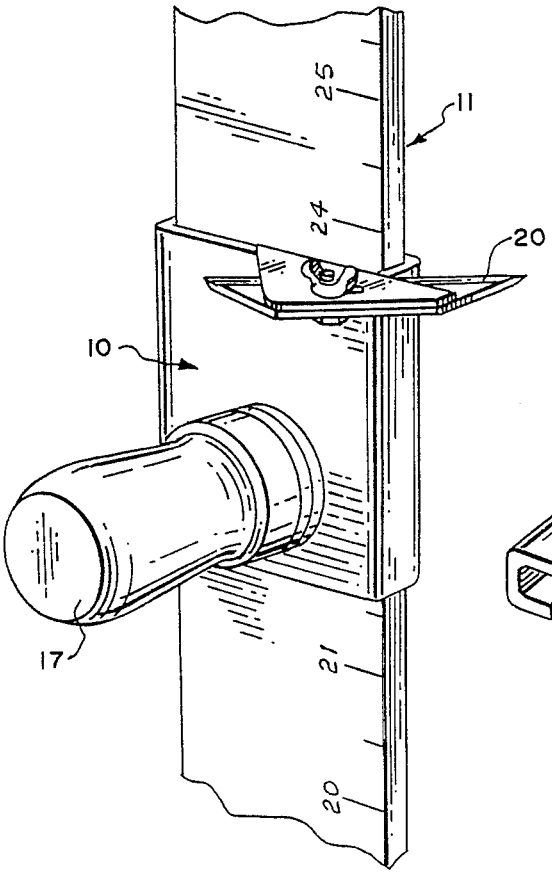
FIG. 2 is an enlarged fragmentary top perspective view of my cutting device as shown in FIG. 1.

The reference numeral 10 indicates generally my drywall cutting device. The device 10 is adapted to co-act with a T-square 11, and more particularly with a stem 12 of the T-square 11. The T-square 11 also includes a cross piece portion 13 which is adapted to engage with an edge of a drywall board B (FIG. 1) which serves to engage in edge of the board and the co-action of the cross piece portion of the T-square 11 and the edge of the board B co-act as a guide for the drywall cutting device 10 as it is drawn across the board B to cut the board along a line L to produce a cut edge on the board B.

Figure 4:
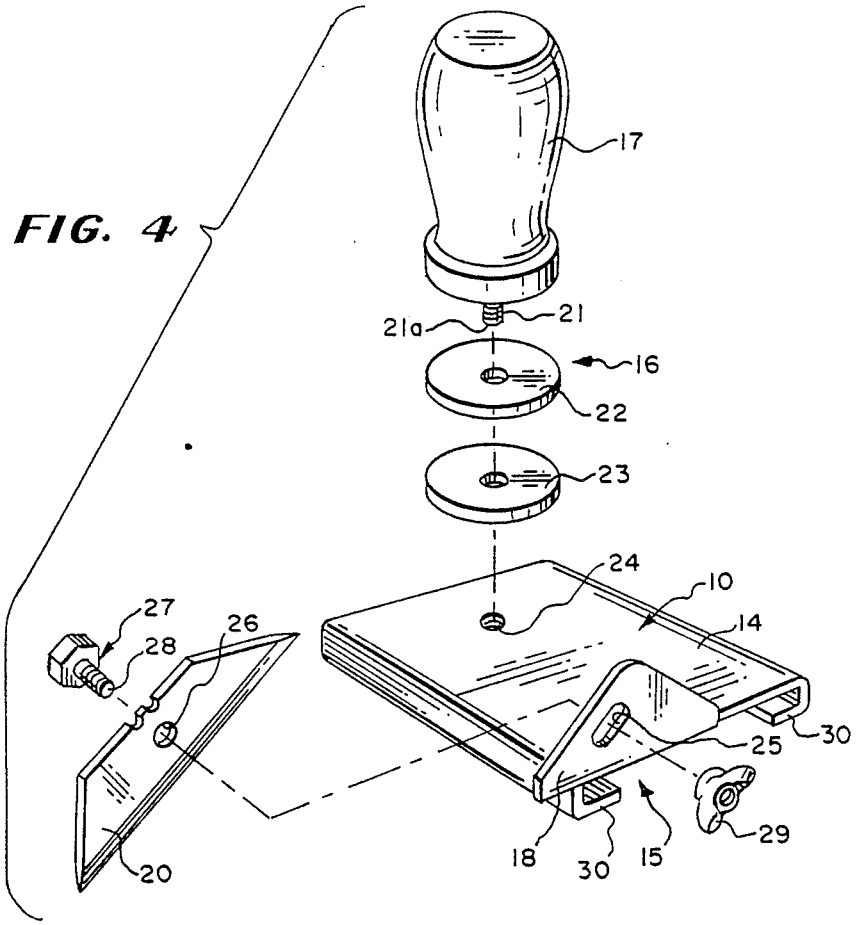
FIG. 4 is an enlarged exploded view of the drywall cutting device shown in FIG. 1–3.

My cutting device 10 further includes a metal or hard synthetic plastic channel-shaped sleeve 14 for slidably mounted disposition on the stem 12 of the T-square 11 at predetermined selectable positions. The sleeve 14 further defines a channel indicated generally at 15 (FIG. 4) and it is this channel that is adapted to co-act and engage with the stem 12 of the T-square 11, as seen in FIG. 1. The sleeve 14 is preferably made from steel.

A clamping device 16 is mounted on the channel-shaped sleeve 14 for retaining the sleeve in a predetermined selected fixed position on the stem of a T-square. To this end, the clamping device is attached or joined integral with a wooden handle 17 positioned top side of the channel-shaped sleeve 14 as shown in the drawings. Also mounted in the channel-shaped sleeve 14 is a knife holder 18. The knife holder 18 is welded at 19 to one end of the channel-shaped sleeve 14. When the knife holder 18 is mounted on the sleeve, it extends above the sleeve on the same side of the sleeve as the handle 17. A sharp bevel edged knife 20 is adjustably secured with the knife holder 128 at right angles to the stem 12 of the T-square for cutting along the line L perpendicular to the stem of the T-square when the clamping device and the T-square are drawn together across a surface to be cut such as the drywall board B. The knife 20 can be manufactured from any suitable material and its shape can be varied as may be necessary.

The clamping device 16 further includes a threaded screw 21 and a pair of washers 22 and 23. One end (not shown) of the screw 21 is threadingly secured in the wood material of the handle 17. The threaded screw 21 is retainingly engaged in a threaded hole 24 (FIG. 4) in threaded assembly therewith. A threaded screw end **21*a* of the threaded screw 21 is adapted to extend through the channel-shaped sleeve 14 into the channel 15 for co-action with the stem 12 of the T-square 11** to fixedly secure the components together.

Figure 3:
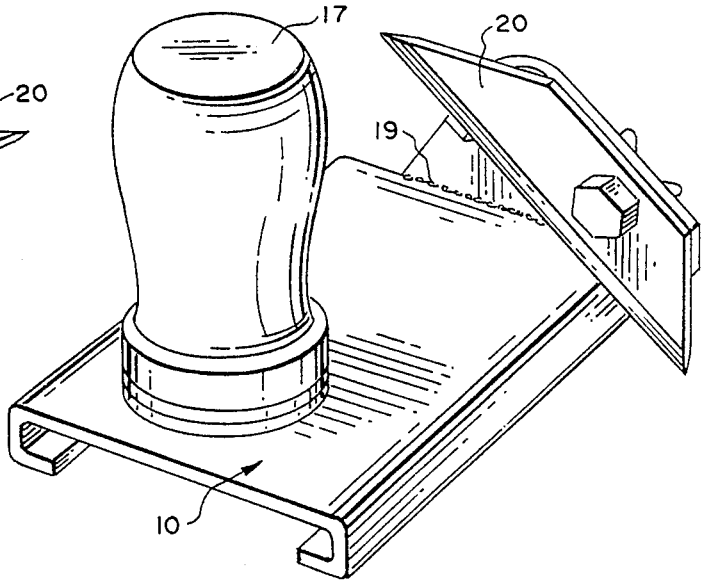
FIG. 3 is an end perspective view of my cutting device.
Figure 6:
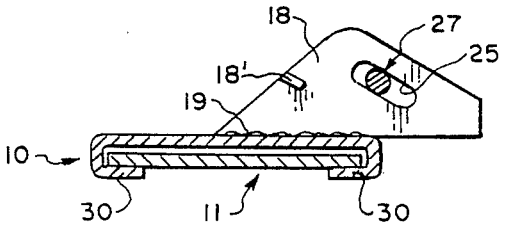
FIG. 6 is a vertical section taken on the line 6—6 looking in the direction indicated by the arrows as seen in FIG. 5.

The knife 20 can be adjustably positioned on the knife holder 18 and to this end, the knife holder 18 is provided with an elongated slot 25. The knife blades 20 have bolt slots 26. Fasteners 27 in the form of a threaded bolt 28 and a wing nut 29 are provided. The fasteners 27 are provided for securing the knife blade 20 to the knife holder 18. To this end, the bolt 28 extends through the blade hole 26 and through the elongated slot 25 in the knife holder 18 and thereafter the wing nut 29 is threadingly connected with the threads of the bolt 28 to secure the components in assembly. The elongated slot 25 enables the blade 20 to be adjustably positioned relative to the blade or knife holder 18. The blade mount or knife holder 18 is also provided with a stop 18' (FIG. 6) which co-acts with the blade (FIG. 3) to further secure the blade 20 against movement when the cutting guide 10 is used to make a cut. When the wing nut 29 is tightly secured, then the adjusted position of the blade or knife 20 can be maintained.

Figure 5:
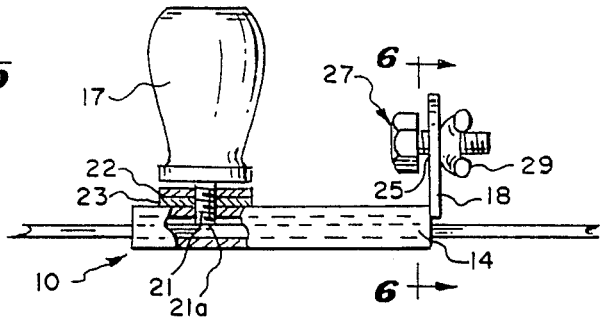
FIG. 5 is an end view of my drywall cutting device.

Now, according to my invention my cutting guide 10 can be easily operated when mounted on and used in combination with a T-square. To this end, the cutting guide 10 can be set at the desired width or position relative to the drywall board B and then the clamping device 16 can be secured by turning the handle 17 to cause the threaded end **21*a* of the screw 21 to be engaged against the stem 12 of the T-square 11. The threaded screw 21 forces the board B against under turned sleeve legs 30—30 in snug engagement therewith so as to prevent slippage between the drywall cutting device and the T-square 11. When the board B (FIG. 5) is tightly secured in place, a gap G is generated above the washers 22, 23 and beneath the handle 17. Now the T-square 11 can be placed on the drywall board B in position to cut along the line L by engaging the cross piece portion 13 against a straight edge E of the drywall board L. The T-square 11 is now in position for cutting horizontally and the cut can be made by holding the cross piece 13 of the T-square 11 firmly with one hand and grasping the handle 17 of the cutting guide 10** with the other hand, and then by pulling evenly with both hands across the drywall board B to score a straight cut as indicated at L.

Figure 7:
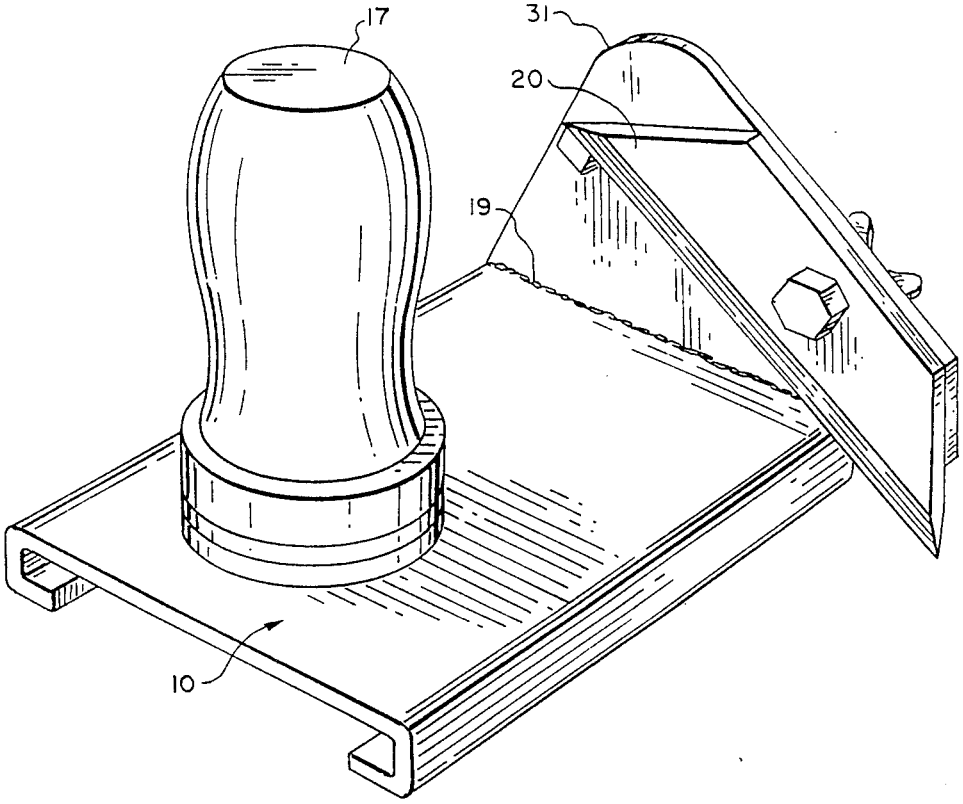
FIG. 7 is a enlarged perspective view of a modified cutting device involving other features of my invention.

Shown in FIG. 7 is a modified form of my invention. In this modified embodiment, the knife holder 18 shown in FIGS. 1–6, has been altered and is indicated generally at 31. The knife holder 31, as illustrated in FIG. 7, has been sized to have a length in excess of the knife at an upper back edge of the knife for guarding against accidental contact therewith. The knife holder 31 comprises a one piece flat plate. By so dimensioning the constructing the knife holder, the user's hand cannot so easily come in contact with the knife as the tool or cutting guide is being used. The extra length of the knife holder 31 acts as a guard to deflect the user's hand out of contact from the back or upper edge of the knife.

In summation, the drywall cutting guide 10 enables the user to create a clean straight horizontal cut across a drywall board with only one step and the operation can be quickly done. When the blade 20 becomes dull, it can be easily removed and the edge can be sharpened or the blade 20 can be replaced as desired.

It is thus seen, therefore, that there is provided an improved article and combination in which the objects of the invention are achieved and which are well adapted to meet all conditions of practical use.

As various possible embodiments may be made in the above invention for use for different purposes and as various changes might be made in the embodiments and method above set forth, it is understood that all of the above matters have set forth or shown in the accompanying drawings are to be interpreted as illustrative and not in a limiting sense.

I claim:

1. A drywall cutting device including a channel-shaped sleeve for slidably mounted disposition on a stem of a T-square at predetermined selectable positions, a clamping device mounted on the channel-shaped sleeve for retaining the sleeve in a predetermined selected fixed position on the stem of a T-square, a knife holder being joined with the sleeve, and a knife adjustably secured with the knife holder at right angles to the stem for cutting a line perpendicular to the stem of the T-square when.the clamping device and the T-square are drawn together across a surface to be cut, said clamping device including a threaded screw extended through said channel-shaped sleeve in threaded assembly therewith, and a screw end extended into a channel-shaped area defined by the channel-shaped sleeve, the end being adapted for retaining engagement with the T-square.

2. The device of claim 1 further characterized by the clamping device including a handle extending above and secured to said channel-shaped sleeve for assisting in drawing said device across a surface to be cut.

3. The device of claim 1 further characterized by the clamping device including a handle extending above and secured to said channel-shaped sleeve for assisting in drawing said device across a surface to be cut.

4. The device of claim 1 further characterized by said knife holder being fixedly attached to said sleeve at one end thereof, the knife being engaged thereagainst, and means securing the knife to said knife holder.

5. A drywall cutting device including a channel-shaped sleeve for slidably mounted disposition on a stem of a T-square at predetermined selectable positions, a handle operated clamping device mounted on and secured with the channel-shaped sleeve for retaining the sleeve in a predetermined selected fixed position on the stem of a T-square, the device including a handle projecting above the sleeve for overlying a T-square, a knife holder being joined with the sleeve, and a knife adjustably secured with the knife holder at right angles to said channel for cutting a line perpendicular to the stem of the T-square when the clamping device and the T-square are drawn together across a surface to be cut.

6. The device of claim 6 further characterized by the handle having a threaded screw extending through said channel-shaped sleeve in threaded assembly therewith and a screw end extended into a channel-shaped area defined by the channel-shaped sleeve, the end being adapted for retaining engagement with the T-square.

7. The device of claim 5 further characterized by said knife holder being welded to said sleeve at one end thereof, the knife being engaged thereagainst, and means securing the knife to said knife holder.

8. In combination, a drywall cutting device and a T-square, the drywall cutting device including a channel-shaped sleeve for slidably mounted disposition on a stem of the T-square at predetermined selectable positions, a handle operated clamping device mounted on and secured with the channel-shaped sleeve for retaining the sleeve in a predetermined selected fixed position on the stem of the T-square, the device including a handle projecting above the sleeve for overlying a T-square, a knife holder being joined with the sleeve, and a knife adjustable secured with the knife holder at right angles to said channel for cutting a line perpendicular to the stem of the T-square when the clamping device and the T-square are drawn together across a surface to be cut.

9. The combination of claim 8 further characterized by the handle having a threaded screw extending through said channel-shaped sleeve in threaded assembly therewith and a screw end extended into a channel-shaped area defined by the channel-shaped sleeve, the end being adapted for retaining engagement with the T-square.

10. The combination of claim 8 further characterized by the channel-shaped sleeve having confronting inwardly extending sleeve legs positioned beneath the handle and cooperable with said handle operated clamping device for urging the stem of the T-square in engagement with the sleeve legs so as to be functionally connected in fixed relation thereto so that the T-square and the drywall cutting device can be used to cut a line perpendicular to the stem of the T-square when drawn together across a surface to be cut.

11. The combination of claim 8 further characterized by said knife holder being sized to have a length in excess of the knife at an upper back edge of said knife for guarding against accidental contact therewith.

12. The combination of claim 5 further characterized by said knife holder comprising a one piece flat plate, the flat plate being dimensioned to have a length in excess of an upper back edge of said knife for guarding against accidental contact therewith.

13. A drywall cutting device including a channel-shaped sleeve for slidably mounted disposition on a stem of a T-square at predetermined selectable positions, a clamping device mounted on the channel-shaped sleeve for retaining the sleeve in a predetermined selected fixed position on the stem of a T-square, a knife holder being joined with the sleeve, and a knife adjustably secured with the knife holder at right angles to the stem for cutting a line perpendicular to the stem of the T-square when the clamping device and the T-square are drawn together across a surface to be cut, said knife holder comprising a one piece flat plate, the flat plate being dimensioned to have a length in excess of an upper back edge of said knife for guarding against accidental contact therewith.

* * * * *